United States Patent [19]

James

[11] Patent Number: 4,586,009

[45] Date of Patent: Apr. 29, 1986

[54] DOUBLE STAGGERED LADDER CIRCUIT

[75] Inventor: Bertram G. James, Redwood City, Calif.

[73] Assignee: Varian Associates, Inc., Palo Alto, Calif.

[21] Appl. No.: 763,935

[22] Filed: Aug. 9, 1985

[51] Int. Cl.[4] ..... H01P 9/00; H01J 25/36

[52] U.S. Cl. ..... 333/156; 315/3.5; 315/39.3; 333/157; 29/600

[58] Field of Search ..... 333/156, 157; 315/3.5, 315/3.6, 39.3; 29/600

[56] References Cited

U.S. PATENT DOCUMENTS

| | | | |
|---|---|---|---|
| 3,400,297 | 9/1968 | Miyamoto | 315/3.5 |
| 4,237,402 | 12/1980 | Karp | 315/3.6 X |
| 4,409,519 | 10/1983 | Karp | 333/156 X |

*Primary Examiner*—Marvin L. Nussbaum

*Attorney, Agent, or Firm*—Stanley Z. Cole; Richard B. Nelson

[57] ABSTRACT

A double-coupled ladder circuit for a traveling-wave tube has been a slow-wave circuit formed of a pair of combs, each cut from a single piece of metal. Transverse grooves are cut in each piece to form teeth and axial grooves are cut in the ends of the teeth. The two combs are joined at teeth ends to form a ladder with the transverse grooves aligned to form cavities and the axial grooves aligned to form a beam passageway. Coupling apertures are cut in both sides of a first set of alternating ladder rungs and a second set of apertures cut in the comb backing members over the second, interleaved, set of rungs. Thus, each cavity is coupled on two opposite sides to its preceding cavity and on the two remaining sides to its following cavity. The double coupling provides increased bandwidth and efficiency. Finally, side plates are affixed to cover the apertures, complete the cavity walls and form the vacuum envelope.

3 Claims, 4 Drawing Figures

DOUBLE STAGGERED LADDER CIRCUIT

FIELD OF THE INVENTION

The invention pertains to traveling wave tubes (TWTs) suitable for very short (millimeter) waves. Where appreciable power is required, such tubes generally use all-metal slow-wave circuits of the "coupled-cavity" or "folded waveguide" or "ladder" types.These classifications are sometimes overlapping.

PRIOR ART

Coupled-cavity circuits per se have been long used. The pertinent prior art as far as millimeter waves are concerned is basically the use of combs, ladders or the like made of single pieces of metal in which the periodicity of the elements is determined by a machining process, rather than by an assembly process wherein mechanical tolerance errors can accumulate.

U.S. patent application Ser. No. 626,467, a continuation of Ser. No. 371,368 filed Apr. 23, 1982, now abandoned by Bertram G. James, Frank C. Dinapoli and Lloyd P. Hayes describes a simple coupled-cavity circuit formed by joining a pair of unitary combs at the front edges of their teeth to form a ladder with broad rungs. The open sides are closed off by extended cover plates to form cavities. One of the plates has an axial groove forming in-line coupling apertures between cavities. This structure is fairly simple. However, the in-line coupling provides only a limited bandwidth.

U.S. Pat. No. 4,409,519 issued Oct. 11, 1983 to Arthur Karp, describes a folded-waveguide circuit, that is a series of cavities coupled on alternating sides, assembled from a pair of unitary ladders whose openings are covered by end-plates having recesses spanning a pair of adjacent cavities. The bandwidth of the folded-waveguide circuit, however, is still too narrow for modern requirements. Also, construction is difficult because four parts must be accurately aligned.

U.S. Pat. No. 4,237,402 issued Dec. 2, 1980 to Arthur Karp describes a different structure, electrically equivalent to a coupled-cavity structure, assembled from four combs into two interleaved ladders. Each cavity is coupled in one axial plane to the cavity on one side of it and in an orthogonal axial plane to the cavity on the other side. These double couplings, which due to symmetry are not themselves mutually coupled, provide an increased bandwidth over single-coupled cavities. This structure has proven quite difficult to build because the four separate combs must be assembled and mounted on the surrounding envelope with great accuracy.

SUMMARY OF THE INVENTION

An object of the invention is to provide a double-coupled slow-wave circuit for a millimeter-wave TWT capable of providing large power and increased bandwidth.

A further object is to provide a circuit which can be manufactured cheaply and yet with greatly improved accuracy.

A further purpose is to provide an easy method of accurately manufacturing a millimeter-wave slow-wave circuit.

These objects are realized by a structure in which the resonant cavities are formed by joining the teeth of a pair of opposed combs to form a ladder, each comb being made of a unitary bar of metal. Grooves in the ends of the teeth join to form a beam passageway through the ladder rungs. Both sides of a first alternating set of rungs are grooved to form a first set of pairs of coupling apertures. At the position of the second alternating set of rungs the backing members of the combs are perforated to form a second set of pairs of coupling apertures orthogonal to the first set. All four open sides of the ladder structure are then closed by cover plates to form an enclosed cavity structure in a vacuum envelope.

DESCRIPTION OF THE PREFERRED EMBODIMENTS

The inventive structure will be described in concert with its method of fabrication. Unique and valuable features of the structure derived from the construction process form valuable attributes of the finished product.

The completed slow-wave structure is of the coupled-cavity type. Individual cavities are self-resonant at a frequency near the desired pass band but somewhat below it. The cavities have plane-parallel top and bottom perpendicular to the central beam-passage hole. Their outline is rectangular, preferably approximately square. Each cavity is coupled to the one following it on two opposite sides by apertures in the wall separating them. It is coupled to the preceding cavity by a pair of apertures on the other pair of opposite sides. This arrangement is known as "double coupling" or "double staggered coupling". Since the coupling apertures are symmetrical about the beam passageway, the microwave electromagnetic fields are symmetric and the electrical field component at the beam is strictly axial providing optimized interaction. The fact that the two pairs of apertures in a given cavity are orthogonal provides that there is no through coupling between non-adjacent cavities, such as the case with prior-art "in-line" coupling.

Figure 1:
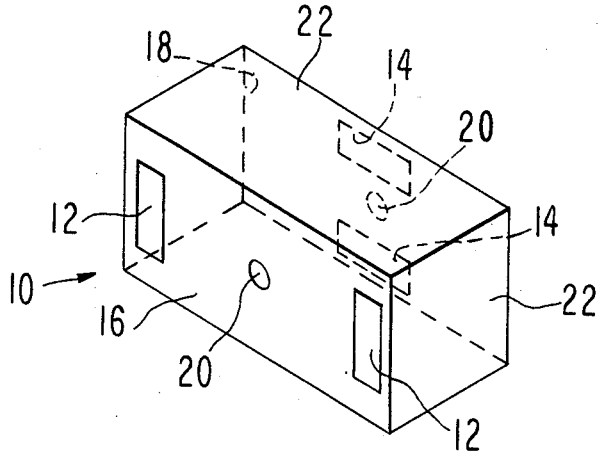
FIG. 1 is a phantom perspective view of one of the cavities.

FIG. 1 is a phantom perspective view of the inside surface of a single cavity 10 to illustrate the relations of the coupling apertures 12,14 in the square end walls 16,18 as related to the beam passage holes 20 and side walls 22. The invention inherently includes this coupling arrangement, but the novelty is incorporated in the structure.

Figure 2:
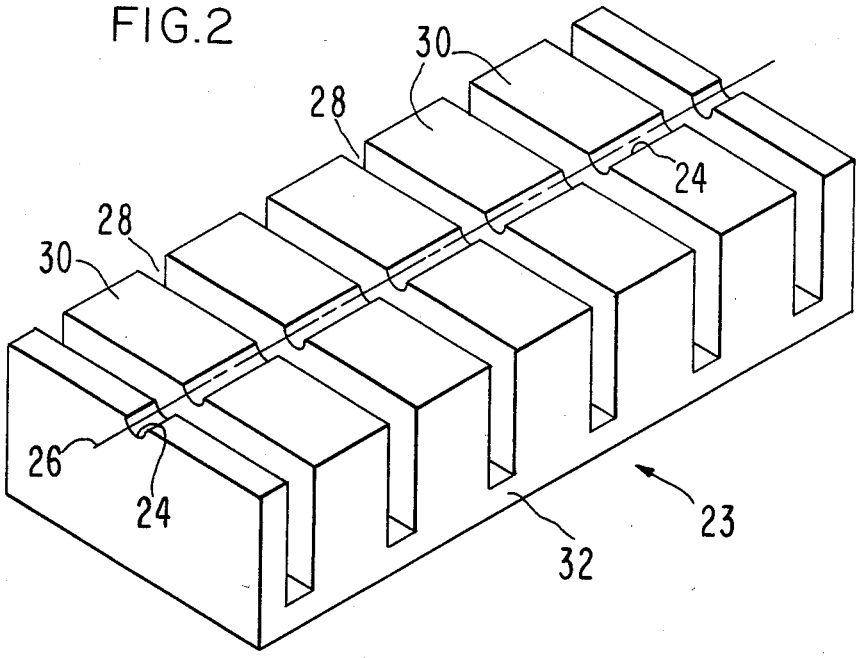
FIG. 2 is an isometric view of a unitary comb element.

FIG. 2 is an isometric view of one of the basic building blocks 23, cut from one piece of metal such as oxygen-free, high conductivity copper (OFHC). The important of this unitary composition is several fold. In assembled structures, the arts are brazed together with alloys such as gold-copper solid solution or copper-silver eutectic. These alloys are much poorer conductors of heat and electricity than pure copper, so they reduce the power-handling capacity. Furthermore, at the joints the molten alloys form fillets which change the effective electrical dimensions. In the tiny structure used for millimeter waves, these irregularities cause cumulative degradation of the wave-propagation properties.

Another major advantage of the unitary construction is that all the important dimensions are formed by machining processes which can be carried out with great accuracy. In particular, the periodic spacing between cavities is not subject to cumulative errors such as occur in stacking a number of brazed-together parts.

Along the top surface of bar 23, a semicylindrical groove 24 is milled along the axis 26. An array of slots 28 are milled as by machine cutting perpendicular to axis 26 and uniformly spaced along it to form a comb structure with flat, parallel teeth 30 supported by a backing member 32.

FIG. 32 illustrates the next step in the fabrication. Two identical combs 23 are brazed together with the front ends of teeth 30 aligned axially to form an array of ladder rungs 40, 42 connecting backing members 32. The two combs are aligned perpendicularly to the axis 26 such that the two hemispherical grooves 24 align to form a hollow cylindrical channel 36 which will transmit the electron beam. In both sides of rungs 40 axial grooves 36 are cut, as by electrical discharge machining (EDM), in a first set of alternating rungs 40. A second interleaving set of alternating rungs 42 are left with flat sides. In both backing members 32 are cut, as by EDM, a set of holes 44 penetrating through backing members 32 to interconnect the grooves 28 on opposite sides of rungs 42 of the second set. Grooves 38 and holes 44 thus form the coupling apertures 12,14 of FIG. 1, while the grooves 28 between rungs 40 form the (not yet enclosed) cavities 10.

At this point an additional machining operation is very beneficial. The cavities between rungs 40 may have some dimensional errors from mechanical machining, some misalignment during brazing, or some extraneous brazing alloy. To correct these, it is desirable to make the original cavities smaller than the desired final desired size, and now EDM them to the final dimensions.

Figure 3:
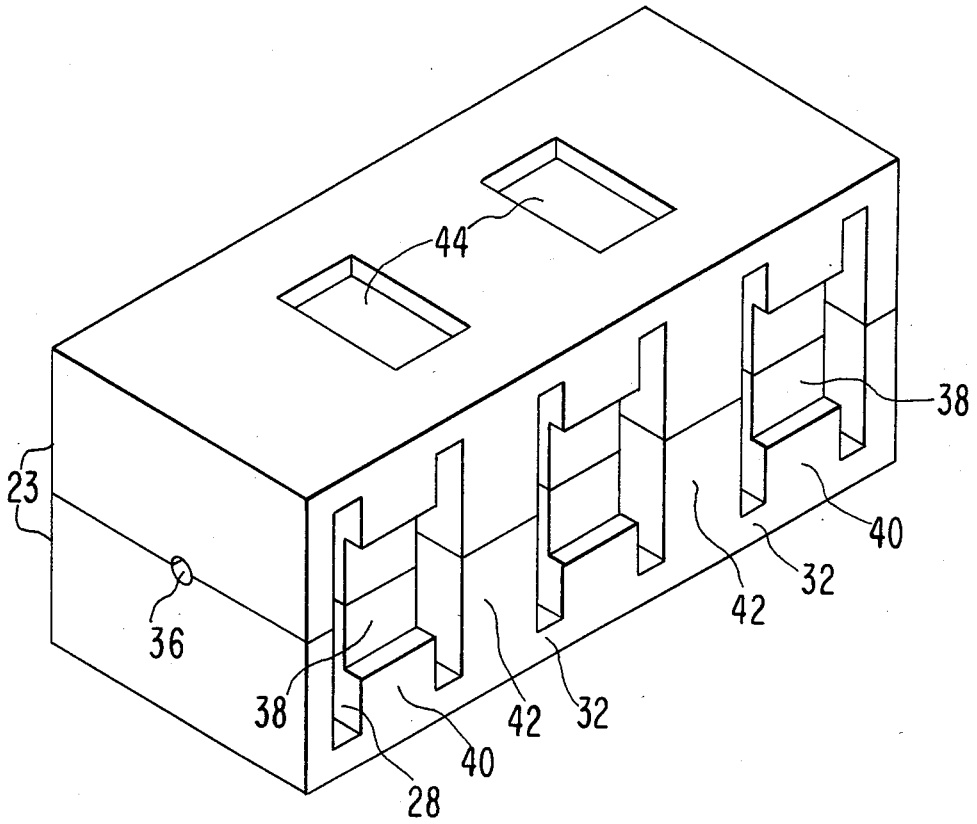
FIG. 3 is an isometric view of a pair of combs joined to form a ladder structure.
Figure 4:
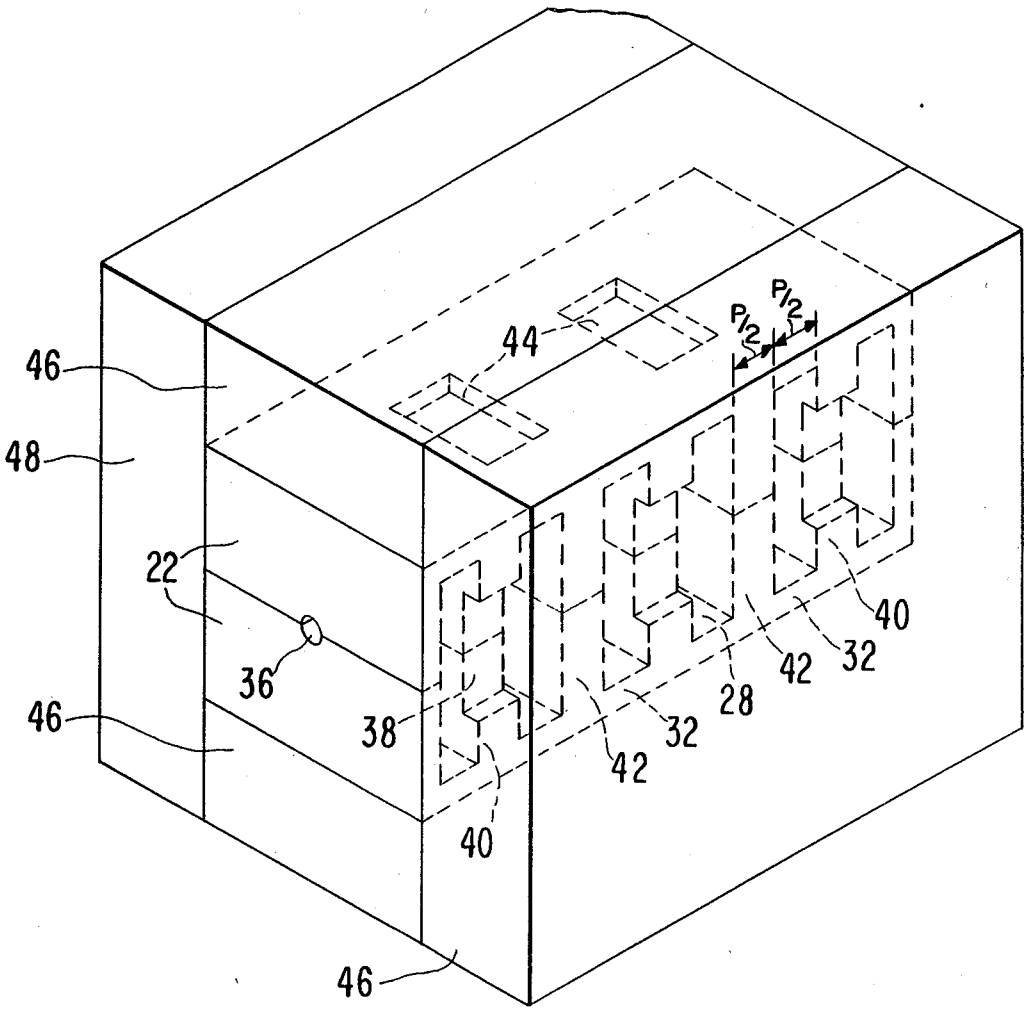
FIG. 4 is an isometric view of the complete enclosed slow-wave structure.

FIG. 4 is an isometric view of the completed slow-wave structure. The cavities of FIG. 3 have been EDM'd to final size. Then the open sides of the structure have been covered by brazing on pairs of cover bars 46 and 48. These heavy bars complete the vacuum envelope, enclose the resonant cavities, provide mechanical strength to the delicate slow-wave structure, and conduct the heat away from it. They are preferably of OFHC copper.

I claim:

1. A slow-wave circuit for a traveling wave tube comprising:

a pair of combs, each comb formed as a unitary metallic piece comprising a backing element extending in an axial direction and a series of flat, generally rectangular teeth periodically spaced in said axial direction and extending from said backing member with their flat sides perpendicular to said axial direction, said teeth having axially aligned grooves in the ends removed from said backing member;

said pair of combs being juxtaposed such that said teeth align axially to form ladder rungs and said grooves join perpendicularly to said axis to form an axial passageway for an electron beam;

a first alternating set of said rungs having grooves in both sides of said rungs;

a set of holes extending through each of said backing elements, each hole connecting with the spaces on both sides of a rung of a second set alternating with said first set, and flat plates affixed to cover the open sides and backing members of said combs;

whereby each cavity formed between adjacent rungs is coupled on two opposite sides to the preceding cavity and on the remaining two sides to the following cavity.

2. A process for fabricating a double-coupled cavity slow-wave circuit for a traveling wave tube comprising the following sequential steps, the components of each step being in any order:

(a) machining a pair of combs having generally rectangular cross section perpendicular to a longitudinal axis, said machining including: cutting a set of grooves perpendicular to said axis and periodically spaced along said axis, leaving between them a set of teeth connected by an axial backing member, and cutting a small axial groove in the ends of said teeth removed from said backing member;

(b) bonding said combs together at said ends of said teeth, said teeth in said pair being axially aligned to form a ladder of rungs alternating with cavities and said small grooves being aligned to form a straight channel, cutting an array of grooves in both sides of a first alternating set of rungs, cutting an array of holes through both of each said backing members, said holes being disposed to span each of a second set of rungs alternating with said first set; and (c) bonding a set of metallic cover plates to the sides of said ladder to cover said grooves and holes to form a continuous envelope and a series of intercoupled hollow cavities.

3. The process of claim 2 further comprising, as a component of step (b), electrical discharge machining of said cavities following said bonding.

* * * * *